US011635000B1

(12) United States Patent
Moody et al.

(10) Patent No.: US 11,635,000 B1
(45) Date of Patent: Apr. 25, 2023

(54) ENDWALL DIRECTIONAL COOLING

(71) Applicants: Rolls-Royce North American Technologies Inc., Indianapolis, IN (US); Rolls-Royce Corporation, Indianapolis, IN (US)

(72) Inventors: Jack Moody, Indianapolis, IN (US); Jerry Layne, Indianapolis, IN (US); Jeffrey F. Rhodes, Indianapolis, IN (US); Brett Barker, Indianapolis, IN (US); Eric Koenig, Indianapolis, IN (US)

(73) Assignees: ROLLS-ROYCE CORPORATION, Indianapolis, IN (US); ROLLS-ROYCE NORTH AMERICAN TECHNOLOGIES INC., Indianapolis, IN (US)

( * ) Notice: Subject to any disclaimer, the term of this patent is extended or adjusted under 35 U.S.C. 154(b) by 0 days.

(21) Appl. No.: 17/560,697

(22) Filed: Dec. 23, 2021

(51) Int. Cl.
*F01D 9/00* (2006.01)
*F01D 25/12* (2006.01)
*F01D 9/04* (2006.01)

(52) U.S. Cl.
CPC ..... *F01D 25/12* (2013.01); *F01D 9/041* (2013.01); *F05D 2240/81* (2013.01); *F05D 2260/202* (2013.01)

(58) Field of Classification Search
CPC . F01D 25/12; F01D 9/041; F01D 9/06; F05D 2240/81
See application file for complete search history.

(56) References Cited

U.S. PATENT DOCUMENTS 3,628,880 A * 12/1971 Smuland ..... F01D 5/189 415/115
3,800,864 A * 4/1974 Hauser ..... F01D 25/12 165/47
6,241,467 B1 6/2001 Zelesky et al.
6,254,333 B1 7/2001 Merry
7,857,580 B1 12/2010 Liang
8,459,935 B1 * 6/2013 Liang ..... F01D 5/187 416/193 A (Continued)

FOREIGN PATENT DOCUMENTS

WO WO 2019/030314 A1 2/2019

OTHER PUBLICATIONS

Uzol et al., "Heat Transfer, Pressure Loss and Flow Field Measurements Downstream of a Staggered Two-Row Circular and Elliptical Pin Fin Arrays," May 2005, pp. 458-471, ASME, *Journal of Heat Transfer*, vol. 127, No. 5.

*Primary Examiner* — Eldon T Brockman
(74) *Attorney, Agent, or Firm* — Crowell & Moring LLP

(57) ABSTRACT

An endwall may be disposed at one end of a vane assembly. The endwall may comprise an endwall spar and a coversheet on the hot surface of the endwall spar. The endwall may further comprise a cooling fluid channel between the hot surface of the endwall spar and the cold surface of the coversheet. The cooling fluid channel may include a cooling fluid inlet disposed in the endwall spar, and a cooling fluid outlet. The cooling fluid outlet may be formed at an angle with the axis of the endwall spar. A plurality of pedestals may be disposed on the hot surface of the endwall spar extending into the cooling channel. The pedestals may be formed at an angle with the axis of the endwall spar to direct a cooling fluid.

20 Claims, 5 Drawing Sheets

(56) References Cited

U.S. PATENT DOCUMENTS

| | | | | |
|---|---|---|---|---|
| 8,517,667 | B1 * | 8/2013 | Liang | F01D 5/186 415/115 |
| 9,790,799 | B2 | 10/2017 | Tagawa et al. | |
| 9,995,157 | B2 * | 6/2018 | Bangerter | F01D 9/02 |
| 2005/0281663 | A1 | 12/2005 | Trindade et al. | |
| 2007/0059171 | A1 * | 3/2007 | Simms | B22C 9/10 416/96 R |
| 2016/0194980 | A1 * | 7/2016 | Thomen | F02C 7/12 415/115 |
| 2017/0234144 | A1 * | 8/2017 | Mugglestone | F01D 25/12 415/178 |
| 2019/0032495 | A1 | 1/2019 | Weaver et al. | |

* cited by examiner

ENDWALL DIRECTIONAL COOLING

BACKGROUND

Present airfoil endwall cooling systems suffer from a variety of drawbacks, limitations, and disadvantages. Accordingly, there is a need for inventive systems, methods, components, and apparatuses described herein.

BRIEF DESCRIPTION OF THE DRAWINGS

The embodiments may be better understood with reference to the following drawings and description. The components in the figures are not necessarily to scale. Moreover, in the figures, like-referenced numerals designate corresponding parts throughout the different views.

DETAILED DESCRIPTION

Figure 1:
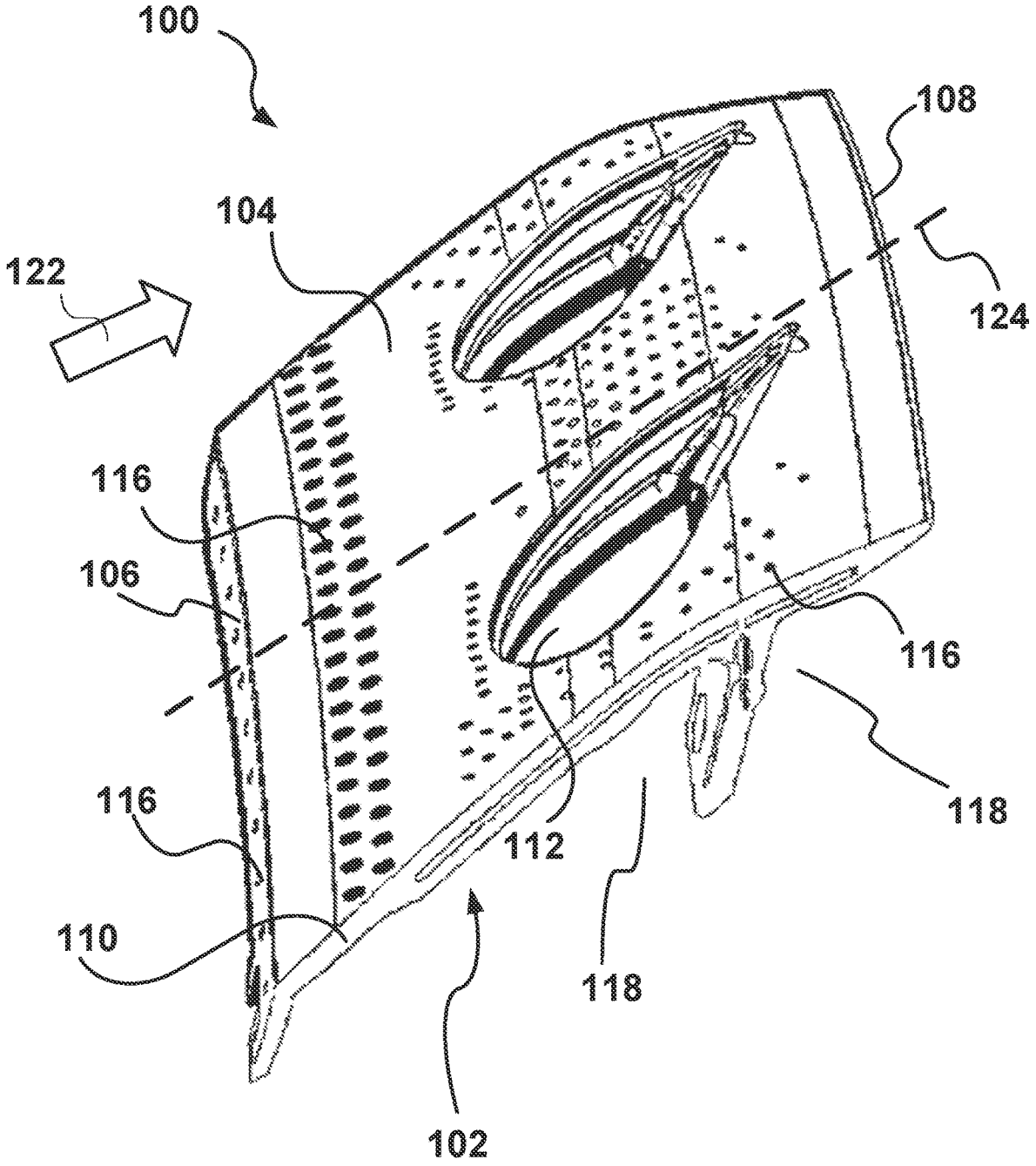
FIG. 1 illustrates an example of an airfoil endwall.

An endwall may be disposed at one end of a vane assembly. The endwall may comprise an endwall spar. The endwall spar may include a cold surface, which is a surface of the endwall that faces away from a main flow of hot gas from, for example, an upstream combustor. The endwall spar may include a hot surface opposite the cold surface, the hot surface being a surface disposed closest to and/or facing the main flow. The endwall spar may include a leading edge, a trailing edge, and an axis extending from the leading edge to the trailing edge, the axis perpendicular to the trailing edge. The endwall may further comprise a coversheet on the hot surface of the endwall spar. The coversheet may include a cold surface facing the hot surface of the endwall spar and a hot surface opposite the cold surface. The endwall may further comprise a cooling fluid channel between the hot surface of the endwall spar and the cold surface of the coversheet. The cooling fluid channel may include a cooling fluid inlet disposed in the endwall spar, and a cooling fluid outlet. The cooling fluid outlet may be formed at an angle with the axis of the endwall spar. Additionally or alternatively, a plurality of pedestals may be disposed on the hot surface of the endwall spar extending into the cooling channel. The pedestals may be formed at an angle with the axis of the endwall spar.

A method of cooling the endwall may comprise directing the cooling fluid through the cooling fluid inlet, directing the cooling fluid through the cooling fluid channel, redirecting the cooling fluid in a direction to match a direction of flow of a primary flow flowing over a hot surface of the coversheet; and ejecting the cooling fluid from the cooling fluid outlet at an angle that matches the direction of flow of a primary flow flowing over a hot surface of the coversheet.

One interesting feature of the systems and methods described below may be that angled pedestals and/or angled cooling fluid outlets swirl and/or direct the cooling fluid to match the flow direction of a primary flow of air passing over the hot surface of the endwall. Swirl may refer to imparting turbulence to a fluid, for example air flowing through the endwall. Swirl may also, for example, refer to directing the cooling fluid in the same direction as a flow of the primary flow (a flow of the hot gas path through the turbine engine, which may also be referred to as the freestream), which may be swirled by airfoils as it flows through a gas turbine engine. The primary flow is directed by airfoils assembled, for example, between a set of inner and outer endwall assemblies. As the primary flow passes between the inner and outer endwalls and over the airfoils, the primary flow is redirected. The angled pedestals and/or angled cooling fluid outlets may redirect and swirl the cooling fluid flowing through the cooling fluid channels so that the cooling fluid is ejected in a flow direction and/or a velocity that is substantially the same as the primary flow.

By directing the cooling air ejected from the cooling fluid outlets so that the cooling air is ejected into the primary flow at the same velocity and/or flow direction as the primary flow, spoiling losses may be reduced and relatively less energy is taken from the primary flow to redirect the ejected cooling fluid as compared to if the cooling fluid was not directed to match the primary flow. Otherwise, if the cooling fluid is ejected into the primary flow at a different angle and/or velocity than the primary flow, the primary flow has to use energy to accelerate and redirect the cooling fluid so the two flows are flowing at the same velocity and direction, which results in a mixing loss. Because cooling fluid may be taken from the upstream compressor in the form of compressor bleed air, lessening the amount of cooling fluid used in the endwall may also improve overall cooling efficiency of, for example, a gas turbine engine.

Alternatively, or in addition, some pedestals and/or cooling fluid outlets of the endwall may be angled to direct the cooling fluid while other pedestals and/or cooling fluid outlets are not angled to direct the cooling fluid and/or angled to a lesser degree. This may increase cooling efficiency, for example, by not directing cooling fluid ejected upstream or towards the leading edge of the endwall so the upstream cooling fluid can create a cooling film over the endwall as it is ejected. Meanwhile, pedestals and/or cooling fluid outlets may be angled to direct cooling fluid ejected downstream, or towards the trailing edge of the endwall to align with the primary flow.

Alternatively, or in addition, an interesting feature of the systems and methods described below may be that the directed ejected cooling fluid can impinge on the downstream blade platform for additional cooling benefit.

FIG. 1 illustrates an example of an endwall 100. The endwall 100 in the illustrated example includes an endwall spar 102, a coversheet 104, a leading edge 106, a trailing edge 108, sidewalls 110, an airfoil opening 112, cooling fluid inlets 200 (shown in FIG. 2), cooling fluid outlets 116, cooling fluid source cavities 118, and cooling fluid channels 120. The leading edge 106 and the trailing edge 108 dictate a position of the endwall 100 in the gas turbine engine relative to the direction of a primary flow 122. The primary flow 122 may be, for example, a flow of hot gas from an upstream combustor (not shown). The primary flow 122, which can also be referred to as the freestream, may flow from the leading edge 106 to the trailing edge 108 during operation of the gas turbine engine. The leading edge 106 may be the edge of the endwall 100 closest to the widest end of the airfoil opening 112. The trailing edge 108 may be the edge of the endwall 100 closest to the narrowest end, or tail, of the airfoil opening 112.

The endwall 100 may be disposed at a circumferentially inner and/or circumferentially outer end of an airfoil, for example, a vane. The coversheet 104 may form an outer wall of the endwall 100, for example, a structure of the endwall 100 disposed closest to the primary flow 122, and the endwall spar 102 may form an inner structure of the endwall 100, for example, a structure of the endwall 100 disposed furthest away from the primary flow 122. The coversheet 104 may be disposed on top of the endwall spar 102, forming cooling fluid channels 120 between the coversheet 104 and endwall spar 102. The cooling fluid outlets 116 may be disposed in the coversheet 104. Alternatively or in addition, the cooling fluid outlets 116 may be disposed in the endwall spar 102, for example, in the leading edge 106 and/or the trailing edge 108 of the endwall spar 102. The cooling fluid outlets 116 may be in fluid communication with the cooling fluid channels 120. The airfoil openings 112 may extend through the endwall 100, for example, through the coversheet 104 and the endwall spar 102.

The endwall 100 may be part of an airfoil assembly, for example, a vane assembly. The endwall 100 may be part of a doublet, or airfoil assembly with two airfoils. The endwall 100 may be a dual wall endwall, wherein the cooling channels 120 are disposed between dual walls. The coversheet 104 may form an outer wall of the dual walls of the endwall 100, or a wall of the dual walls of the endwall 100 disposed nearest to the primary flow 122. The endwall spar 102 may form an inner wall of the dual walls of the endwall 100, or a wall of the dual walls of the endwall 100 disposed furthest from the primary flow 122. The endwall 100, when installed, may be part of a gas turbine engine, for example. The gas turbine engine may be, for example, a gas turbine engine that supplies power to and/or provides propulsion of an aircraft. Examples of the aircraft may include a helicopter, an airplane, an unmanned space vehicle, a fixed wing vehicle, a variable wing vehicle, a rotary wing vehicle, an unmanned combat aerial vehicle, a tailless aircraft, a hover craft, and any other airborne and/or extraterrestrial (spacecraft) vehicle. Alternatively, or in addition, the gas turbine engine may be utilized in a configuration unrelated to an aircraft such as, for example, an industrial application, an energy application, a power plant, a pumping set, a marine application (for example, for naval propulsion), a weapon system, a security system, a perimeter defense or security system.

The leading edge 106 may be the forward-most edge disposed at the front of the endwall 100. The endwall 100 is designed to have the primary flow 122, such as a flow of hot gases exiting a combustor of a gas turbine engine, flow over the coversheet 104 of the endwall 100. The front of the endwall 100 may be considered the side of the endwall 100 facing into the primary flow 122. Alternatively, or additionally, the leading edge 106 may be the most upstream edge of the endwall 100. Upstream refers to a direction opposite of the direction of the primary flow 122. The trailing edge 108 may be at the back of the endwall 100. The back of the endwall 100 may be the side of the endwall 100 opposite of the front and/or opposite of the leading edge 106 of the endwall 100. The trailing edge 108 may be the most downstream edge of the endwall 100. Downstream refers to the direction of the primary flow 122. The leading edge 106 may be opposite the trailing edge 108. An axis 124 may extend along the endwall 100 from the leading edge 106 to the trailing edge 108, perpendicular to the leading edge 106 and/or the trailing edge 108.

The endwall spar 102 may form an inner structure of the endwall 100, or a structure of the endwall 100 disposed furthest from the primary flow 122. For example, the endwall spar 102 may form an inner structure of the cooling fluid channels 120, for example, a cold surface of the cooling fluid channel 120, opposite the coversheet 104. Alternatively or additionally, the endwall spar 102 may form at least part of one or more of the cooling fluid source cavities 118 of the endwall 100.

A cold surface may refer to a surface of a component or structure that faces away from the primary flow 122 of hot gas from, for example, from an upstream combustor. A hot surface may refer to a surface of a component or structure that is a surface disposed closest to and/or facing the primary flow 122. The hot surface may be a surface of the component or structure opposite the cold surface.

The endwall spar 102 may be any structure that forms at least a portion of a radially inner and/or radially outer surface of an airfoil ring, for example, a ring of blades or vanes of an turbine engine. The endwall spar 102 may extend along or parallel to an axis, for example the endwall spar 102 may extend parallel to the central axis of a turbine engine, between two components. For example, between a combustor upstream of the endwall 100 and a downstream row of blades or vanes. The endwall spar 102 and/or blocking structure 114 may be composed of any rigid structural material, for example, a metal and/or a composite material. The cooling fluid source cavity 118 may extend along the endwall spar 102.

The cooling fluid source cavities 118 may be divided into multiple, separate cooling fluid source cavities 118 by a structure of the endwall 100. For example, a portion of the endwall 100 may divide an upstream cooling fluid source cavity 118 disposed closer to the front of the endwall 100 from a downstream cooling fluid source cavity 118 disposed closer to the back of the endwall 100. One of the upstream cooling fluid source cavities 118, for example, the upstream cooling fluid source cavity 118, may contain cooling fluid at a higher pressure than the cooling fluid of a downstream cooling fluid source cavity 118. The upstream cooling fluid source cavity 118 may provide cooling fluid at a higher pressure to a cooling fluid channel 120 that cooling fluid provided by a downstream cooling fluid source cavity 118. The higher pressure cooling fluid, for example, air bled from an upstream compressor, may be provided to the upstream cooling fluid source cavity 118, for example, located at a point closer to the end of the compressor. Lower pressure bleed air provided to a downstream cooling fluid source cavity 118 may be bled from a point earlier in the compressor.

The coversheet 104 may form an outer wall of the endwall 100, for example, a wall of the endwall 100 disposed closest to the primary flow 122. The coversheet 104 may partially surround, partially encompass, and/or be disposed on the endwall spar 102 between the endwall spar 102 and the primary flow 122. The cooling fluid channel 120 may be disposed between the endwall spar 102 and the coversheet 104.

Figure 2:
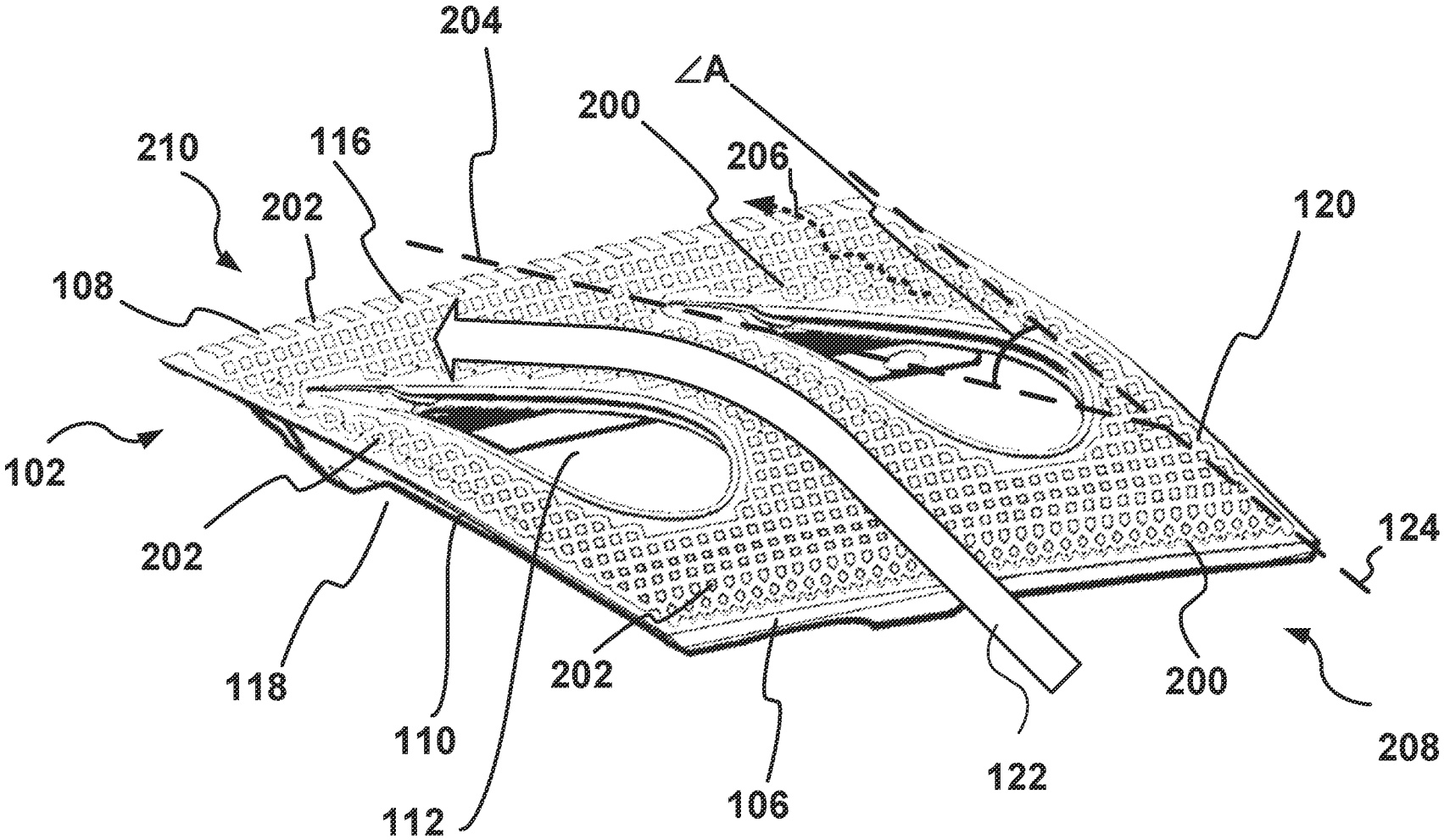
FIG. 2 illustrates an example of an airfoil endwall with the coversheet removed.

A plurality of cooling fluid channels 120 may be disposed between a hot surface of the endwall spar 102 and a cold surface of the coversheet 104. The cooling fluid channels 120 may be any type of passage extending through the endwall 100 capable of directing a cooling fluid 206 (shown in FIGS. 2 and 4) from a cooling fluid inlet 200 to a cooling fluid outlet 116. Each cooling fluid channel 120 may include a cooling fluid inlet 200 (only a subset of the cooling fluid inlets shown in FIG. 2 are designated the cooling fluid inlet 200) and/or a cooling fluid outlet 116 (only one of the cooling fluid outlets shown in FIG. 2 are designated as the cooling fluid inlet 116). The cooling fluid inlet 200 may connect the cooling fluid channel 120 to a cooling fluid source cavity 118 via a cooling fluid inlet 200 so that the cooling fluid channel 120 and the cooling fluid source cavity 118 are in fluid communication. The cooling fluid outlet 116 may connect the cooling fluid channel 120 to a primary flow 122 of, for example, hot gas external to the endwall 100 so that the cooling fluid channel 120 is in fluid communication with a fluid flowing over and/or around the endwall 100 and/or the hot surface of the coversheet 104.

The cooling fluid channel 120 may be formed by the gap and/or space between the hot surface of the endwall spar 102 and the cold surface of the coversheet 104. The cooling fluid channel 120 may cool the endwall 100. cooling fluid channel 120 may include a channel formed between the endwall spar 102 and the coversheet 104. The cooling fluid channel 120 may be a dual feed cooling fluid channel, a counter feed cooling fluid channel, and/or a co feed cooling fluid channel. A dual feed cooling fluid may include at least two cooling fluid inlets 200 and at least one cooling fluid outlet 116. The two cooling fluid inlets 200 may be spaced apart from each other along the endwall 100, wherein the cooling fluid inlets 200 are disposed at opposite ends of the cooling fluid channel 120 and the cooling fluid outlet 116 is disposed between the cooling fluid inlets 200, for example, downstream of one of the cooling fluid inlets 200 and upstream of another one of the cooling fluid inlets 200.

Figures 3A, 3B:
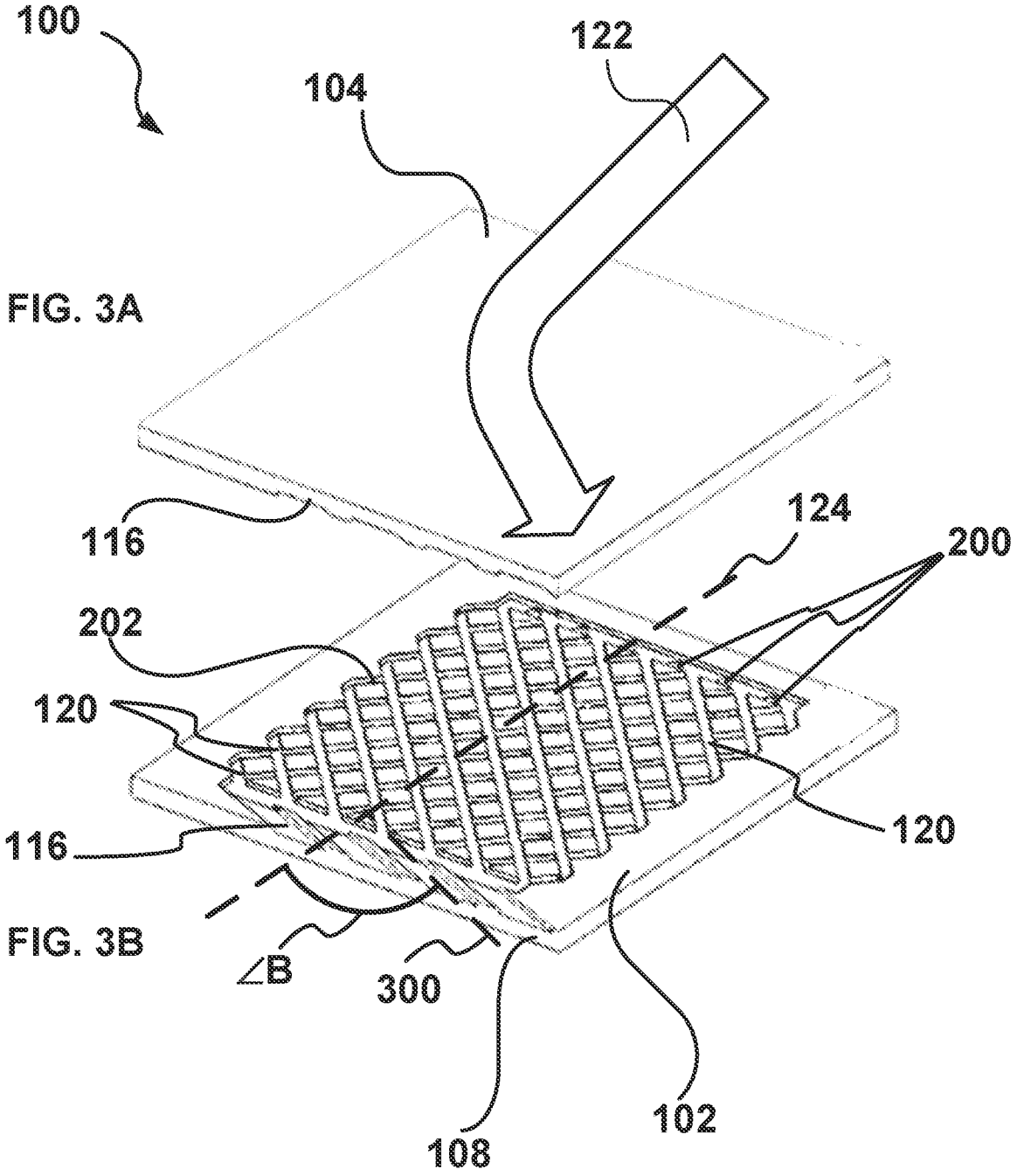
FIG. 3A illustrates an example of a portion of an airfoil endwall coversheet.
FIG. 3B illustrates an example of a portion of an airfoil endwall.

FIG. 3A illustrates an example of a portion of the coversheet 104 that covers a corresponding example portion of the endwall spar 102 shown in FIG. 3B. The cooling fluid inlets 200 may be any sort of aperture in the endwall spar 102, extending through the endwall spar 102 wall from the cooling fluid source cavity 118 (referring back to FIG. 1) to the cooling fluid channel 120. The cooling fluid inlets 200 may be, for example, a through-hole formed via machining or casting. The cooling fluid inlets 200 may be perpendicular to the endwall spar 102 surface, or may be formed at an acute or obtuse angle with the endwall spar 102 surface.

The cooling fluid outlets 116 may be film holes disposed in the coversheet 104 as shown in FIG. 1. Alternatively or in addition, the cooling fluid outlets 116 may disposed at the trailing edge 108 of the endwall spar 102 as shown in FIG. 3B. The cooling fluid outlets 116 may be angled to direct the cooling fluid in substantially the same direction as the primary flow 122. The cooling fluid outlets 116 may be any sort of aperture in the coversheet 104, extending through the coversheet 104 from the cooling fluid channel 120 and to the hot surface of the coversheet 104 and/or to any other surface of the endwall 100 configured to be exposed to the primary flow 122. The cooling fluid outlets 116 may, for example, be film holes formed at an angle with the coversheet 104 and/or at an angle with the axis 124 (shown in FIGS. 3A-B) to direct cooling fluid in a film over the hot surface of the coversheet 104 and/or over a hot surface of the endwall 100 downstream from the cooling fluid outlet 116. The cooling fluid outlets 116 in the coversheet 104 may be formed at an angle with a hot surface of the coversheet 104. Alternatively or in addition, the cooling fluid outlets 116 may be angled relative to the axis 124 (for example, as shown in FIGS. 3A-B). In the example shown in FIG. 1, the cooling fluid outlet 116 connects to the cooling fluid channel 120. The cooling fluid outlets 116 may be formed at an angle with the axis 124 to direct the cooling fluid ejected out the cooling fluid outlet 116. The angle of the cooling fluid outlets 116 may direct the ejected cooling fluid to match the direction and/or velocity of the primary flow 122 flowing over the cooling fluid outlet 116.

Alternatively or additionally, the cooling fluid outlets 116 may apertures in the endwall spar 102, for example, disposed at the leading edge 106 and/or trailing edge 108 of the endwall spar 102. Alternatively or additionally, the cooling fluid outlets 116 at the leading edge 106 may be apertures extending through the endwall spar 102 and shaped such that cooling fluid exiting the cooling fluid outlets 116 impinges on an upstream component, for example, a combustor. Additionally or alternatively, cooling fluid outlets 116 on or near the trialing edge 108 of the endwall 100 may direct cooling fluid onto downstream components, for example, a downstream set of blades or vanes.

During operation, a cooling fluid may flow from a cooling fluid source cavity 118. The cooling fluid may come from an upstream component of the turbine engine, for example, bypass air from an upstream compressor. The cooling fluid and the primary flow 122 may be the same fluid that originates from upstream and then is split between a cooling fluid flow and the primary flow 122. For example, during operation, cooling fluid may flow from a cooling fluid source cavity 118 through a cooling fluid inlet 200, downstream from the cooling fluid inlet 200 through a cooling fluid channel 120, and through a cooling fluid outlet 116 downstream of the cooling fluid inlet 200.

FIG. 2 illustrates an example of an endwall spar 102 of the endwall 100. The endwall spar 102 may comprise the airfoil openings, cooling fluid channels 120, cooling fluid inlets 200, and pedestals 202.

The airfoil openings 112 may have chord axis 204 extending from a leading edge of the airfoil opening 112 to trailing edge of the airfoil opening 112. The chord axis 204 may be at an angle ∠A to the axis 124 of the endwall spar 102. The chord axis 204 of the airfoil opening 112 may correspond to a chord axis of an airfoil that is fitted into the airfoil opening 112 during assembly and operation and the endwall 100, for example, in a turbine engine. The chord axis of the airfoil may be disposed at an angle to the leading edge 106 and/or trailing edge 108 of the endwall 100, for example, the airfoil may be disposed at the same angle ∠A to the axis 124 of the endwall spar 102 as the airfoil opening 112. The angle ∠A of the airfoil openings 112 may correspond to an angle of an airfoil assembled with the endwall 100 that may swirl or direct the primary flow 122 of hot gasses coming from an upstream combustor. In other examples, the airfoil(s) may be integral to the endwall spar 102.

Additionally or alternatively, a station of a turbine, for example, a turbine engine, may comprise the enwall 100 and airfoils disposed in the airfoil openings 112 of the endwall 100. The end of the station near and/or at the leading edge 106 of the endwall 100 may be referred to as the airfoil inlet 208, as it is the side of the endwall 100 and/or station the primary flow 122 enters from, for example, from an upstream station of the turbine engine. Additionally or alternatively, the end of the station near/or at the trailing edge 108 of the endwall 100 may be referred to as the airfoil outlet 210, as it is the side of the endwall 100 and/or station the primary flow 122 exits from as it flows to a downstream station of the turbine. As the primary flow 122, which, for example, may be hot gas from an upstream combustor, flows through the turbine, it may flow through the airfoil inlet 208 and through the section comprising the endwall 100. Airfoils disposed in the airfoil openings 112 of the endwall 100 may turn the primary flow 122 as the primary flow 122 flows over the endwall 100 and through the section. The airfoils may turn the flow so that at the airfoil outlet 210 the flow is turned and redirect, for example, in a non-axial direction.

The cooling fluid inlets 200 may connect the cooling fluid source cavity 118 to the cooling fluid channel 120. Different cooling fluid inlets 200 may connect different cooling fluid source cavities 118 to the same cooling fluid channel 120 and/or to different cooling fluid channels 120. The cooling fluid inlets 200 may be disposed near and/or immediately adjacent to the leading edge 106 of the endwall spar 102. Additionally or alternatively, the cooling fluid inlets 200 may be disposed at any point on the endwall spar 102 between the leading edge 106 and the trailing edge 108 of the endwall spar 102. The cooling fluid inlets 200 may be disposed between pedestals 202. The endwall spar 102 may comprise cooling fluid channels 120 forming a network of connected cooling fluid channels 120 and pedestals 202, with multiple cooling fluid inlets 200 feeding the connected cooling fluid channels 120. Additionally or alternatively, the endwall spar 102 may comprise the cooling fluid channels 120 that are separate from each other, with one or more cooling fluid inlets 200 feeding separate cooling fluid channels 120.

The pedestals 202 may extend away from the endwall spar 102 towards the coversheet 104. The pedestals 202 may, for example, be rectangular, diamond, and/or hexagonal in shape. The pedestals 202 may help increase cooling by increasing the surface area of the endwall spar 102 that the cooling fluid flow over. The pedestals 202 made be made of the same material as the endwall spar 102. The plurality of pedestals 202 may form a patter on the endwall spar 102. The pedestals 202 may be disposed anywhere on the endwall spar 102 between the leading edge 106 and the trailing edge 108 of the endwall spar 102. Pedestals 202 may, for example, be disposed on or near the trailing edge 108 and form outlets 116 between the pedestals 202.

During operation, cooling fluid may flow from cooling fluid source cavities 118 to the cooling fluid channels 120 via the cooling fluid inlets 200. The cooling fluid may flow through the cooling fluid channels 120, around the pedestals 202, and out the cooling fluid outlet 116. The cooling fluid may flow out the cooling fluid outlets 116 and over the hot surface of the coversheet 104. Additionally or alternatively, cooling fluid may exit cooling fluid outlets 116 at the leading edge 106 and/or trailing edge 108 of the endwall spar 102 and impinge on components upstream or downstream of the endwall 100.

During operation, hot gas from the primary flow 122 may flow over the airfoils assembled with the endwall 100. The angle of the airfoils may redirect the primary flow 122 of hot gas downstream of the airfoils.

FIGS. 3A and 3B illustrate an example of the coversheet 104 and the endwall spar 102 of the endwall 100.

The cooling fluid outlets 116, for example, cooling fluid outlets at the trailing edge 108 of the endwall spar 102 and/or cooling fluid outlets 116 formed in the coversheet 104 as, for example, film holes, may include an axis 300 of the outlet that extends through an aperture of the cooling fluid outlet 116. The axis 300 of the cooling fluid outlet 116 may be formed at an angle ∠B to the axis 124 of the endwall spar 102, for example, when measured from the axis 124 at the trailing edge 108 of the endwall spar 102. The ∠B of the cooling fluid outlets 116 may be formed at the same angle ∠A to the axis 124 as the chord axis 204 of the airfoil opening 112 or of an airfoil that fits inside of the airfoil openings 112. This may cause cooling fluid ejected out of the cooling fluid outlets 116 to be ejected in a direction that matches the flow vector of the primary flow 122 of hot gas that passes over the endwall 100 once it is redirected by airfoils. Additionally or alternatively, the angle ∠B of the axis 300 the cooling fluid outlet 116 may be different than the angle ∠A of the chord axis 204 of the airfoil opening 112 or of the airfoils. The angle ∠B of the axis 300 may, for example be in the range of 30 degrees to 80 degrees. The angle ∠B may, for example, be 45 degrees.

Additionally or alternatively, the angle ∠B of the cooling fluid outlets 116 may vary or be different than the angle ∠B of other cooling fluid outlets 116. For example, cooling fluid outlets 116 disposed upstream near the leading edge 106 of the endwall spar 102 may have a lesser angle ∠B relative to the axis 124 and/or be less than the angle ∠A of the airfoil openings 112 in order to form a more effective cooling film with the ejected cooling fluid. Additionally or alternatively, cooling fluid outlets 116 disposed downstream near the trailing edge 108 of the endwall spar 102 may have a greater angle ∠B relative to the axis 124 and/or be closer to the angle ∠A of the airfoil openings 112 in order to more effectively direct the eject cooling fluid.

During operation, cooling fluid may flow through cooling fluid inlets 200, through the cooling channels 120, and the cooling fluid outlets 116. As the cooling fluid 206 (shown in FIGS. 2 and 4) flows through the cooling fluid outlets 116, the cooling fluid may be redirected to a flow direction with an angle ∠B relative to the axis 124 of the endwall spar 102. The angle of the redirected flow, angle ∠B, may match an angle of flow of the primary flow 122 flowing over the hot surface of the endwall 100 such that the flow ejected from the cooling fluid outlets 116 is not redirected by the primary flow 122 as both streams are flowing in the same direction when they meet and merge streams.

Figure 4:
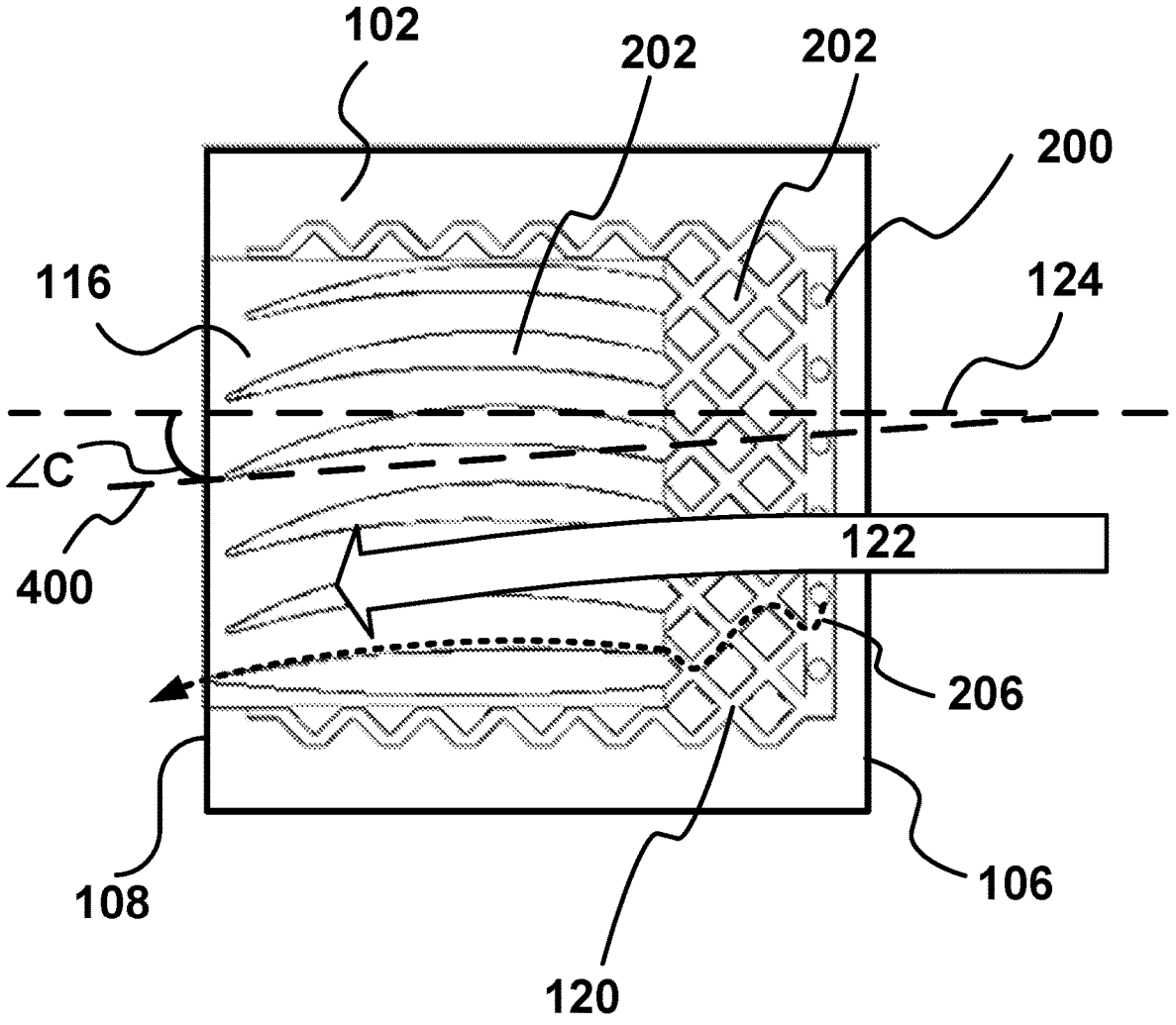
FIG. 4 illustrates an example of a portion of an airfoil endwall.

FIG. 4 illustrates an example of an endwall spar 102 of an endwall 100. The endwall spar 102 may comprise angled, curved, and/or elongated pedestals 202. The angled pedestals 202 may, for example, be in the shape of airfoils, with the thicker end of the airfoil shaped pedestal 202 disposed closer to the cooling fluid inlets 200 and the tail of the airfoil shaped pedestals disposed near the cooling fluid outlets 116. Additionally or alternative, the angled pedestals 202 may be any shape that redirects the cooling fluid 206 as it flows over and around the angled pedestals 202 so the angled pedestals 202 direct and/or swirl the cooling fluid. The angled pedestals 202 may direct the cooling fluid such that the cooling fluid leaves the pedestal 202 flowing in the same direction as the primary flow 122. Alternatively or additionally, the angled pedestals 202 may swirl the cooling fluid so that the cooling fluid 206 turbulently flows through the cooling fluid channel 120 and more efficiently cools the endwall 100.

The angled pedestals 202 may include an axis 400 of the pedestal 202, the axis 400 extending from a leading edge of the pedestal 202 to a trailing edge of the pedestal 202 so that the axis 400 extends in the direction that cooling fluid 206 will be redirected as it flows over the pedestal 202. In the case of airfoil shaped pedestals 202, the axis 400 may be the chord axis of the airfoil shape, extending from a leading edge of the pedestal 202 to a trailing edge of the pedestal 202.

The axis 400 of the pedestal 202 may be formed at an angle ∠C to the axis 124 of the endwall spar 102, for example, when measured from the axis 124 at the trailing edge 108 of the endwall spar 102. The ∠C of the pedestal 202 may be formed at the same angle ∠A to the axis 124 as the chord axis 204 of the airfoil opening 112, of an airfoil that fits inside of the airfoil openings 112, and/or of an axis 300 of a cooling fluid outlet 116. This may cause cooling fluid 206 that flows over the pedestal 202 to be redirected in a direction that matches the flow vector of the primary flow 122 of hot gas that passes over the endwall 100 once it is redirected by airfoils. Additionally or alternatively, the angle ∠C of the axis 400 the pedestals 202 may be different than the angle ∠A of the chord axis 204 of the airfoil opening 112, the airfoils, and or of an axis 300 of a cooling fluid outlet 116. The angle ∠C of the axis 400 may, for example be in the range of 30 degrees to 80 degrees. The angle ∠C may, for example, be 45 degrees.

Additionally or alternatively, the angle ∠C of the pedestals 202 may vary or be different than the angle ∠C of other pedestals 202. For example, pedestals 202 disposed upstream near the leading edge 106 of the endwall spar 102 may have a lesser angle ∠C relative to the axis 124 and/or be less than the angle ∠A of the airfoil openings 112 in order to form a more effective cooling film with the cooling fluid flowing over the pedestals 202. Additionally or alternatively, pedestals 202 disposed downstream near the trailing edge 108 of the endwall spar 102 may have a greater angle ∠C relative to the axis 124 and/or be closer to the angle ∠A of the airfoil openings 112 in order to more effectively direct and/or swirl the eject cooling fluid.

The endwall spar 102 may comprise a mix of angled pedestals 202 and pedestals 202 of other shapes, for example, diamond shaped pedestals 202. The shape of the pedestals 202 may be optimized to eject cooling fluid from the cooling fluid outlets 116 at a specific angle and velocity that substantially matches the flow direction and/or flow vector of the primary flow 122 of hot gas flowing along the hot surface of the coversheet 104 at the corresponding location of the pedestal 202.

The shape of the pedestals 202 may decrease the pressure drop experienced by the cooling fluid 206 as it flows through the cooling fluid channel 120 as compared to a pressure drop experienced by cooling fluid flowing through a cooling fluid channel 120 with other shaped pedestals, for example, only diamond, square, hexagonal, and/or rectangular pedestals. The pressure of the cooling fluid exiting the cooling fluid outlets 116 may be substantially the same of higher than a pressure of the primary flow 122 flowing over the hot surface of the coversheet 104 and endwall 100 at the axial location of the cooling fluid outlet 116, which may minimize spoiling losses.

During operation, cooling fluid may flow in the cooling fluid inlets 200, over the diamond pedestals 202 and/or angled pedestals 202, and out cooling fluid outlets 116. As the cooling fluid 206 flows over and around the pedestals 202, the cooling fluid may be swirled and/or redirected to a flow direction with an angle ∠C relative to the axis 124 of the endwall spar 102. The angle of the redirected flow, angle ∠C, may match an angle of flow of the primary flow 122 flowing over the hot surface of the endwall 100 such that the flow leaving the downstream end of the pedestal 202 and ejected from a cooling fluid outlet 116 does not need to be redirected by the primary flow 122 as both streams are flowing in the same direction when they meet and merge streams. The cooling fluid outlets 116 and angled pedestals 202 may work conjunction to direct the cooling fluid to a final velocity and/or direction matching the flow of the primary flow 122.

The cooling fluid may be ejected after flowing over the pedestals 202 in a direction and/or at a velocity that matches the flow of the primary flow 122 so that the cooling fluid is not redirected or sped up by the primary flow 122. Additionally or alternatively, the primary flow 122 is not slowed down by the joining of the ejected cooling fluid that has been redirected by the pedestals 202 and/or outlets 116.

Figure 5:
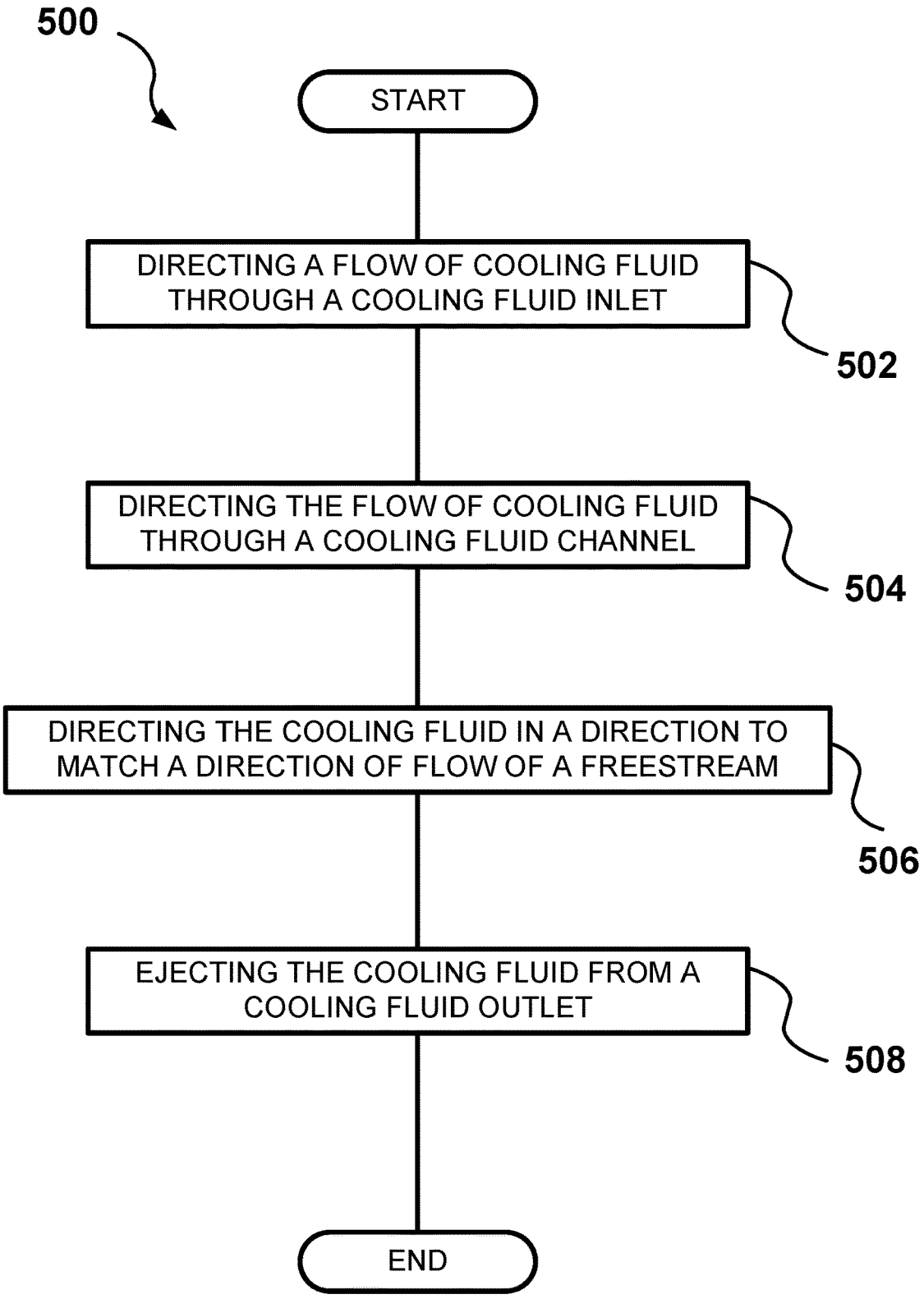
FIG. 5 illustrates an example method for cooling an endwall.

FIG. 5 illustrates a flow diagram of an example of steps to cool the endwall 100 and/or direct the flow of cooling fluid. The method 500 may comprise directing (502) cooling fluid though a cooling fluid inlet 200 of the endwall spar 102. The method may comprise directing (504) the cooling fluid from the inlet 200 through one or more cooling fluid channels 120. The method may comprise directing (506) the flow of cooling fluid at an angle relative to the axis 124 of the endwall spar 102 such that the cooling fluid 206 flows in a direction and/or velocity substantially similar to a direction of flow or flow vector of the primary flow 122 of hot gas flowing along the hot surface of the endwall spar 102. The method may comprise ejecting (508) the cooling fluid from a cooling fluid outlet 116, the cooling fluid now flowing in the same direction as the primary flow 122. The steps may include additional, different, or fewer operations than illustrated in FIG. 5. The steps may be executed in a different order than illustrated in FIG. 5.

Each component may include additional, different, or fewer components. For example, the cooling fluid channel 120 may include multiple cooling fluid channels 120, the pedestal 202 may include multiple pedestals 202, and the cooling fluid inlets 200 and/or the cooling fluid outlets 116 may include multiple inlets 200 and/or cooling fluid outlets 116. Additionally or alternatively, the endwall 100 may include multiple endwall spars 102, multiple corresponding coversheets, and/or multiple cooling fluid channels 120.

The endwall 100 may be implemented with additional, different, or fewer components. For example, the endwall 100 may be implemented with other components of a turbine engine, for example, blades, vanes, combustors, compressors, and/or turbines. The endwall 100 may be implemented with additional endwall assemblies 100. A turbine engine may comprise multiple endwall assemblies 100. For example, multiple endwall assemblies 100 may be placed sidewall 110 to sidewall 110 to form a continuous ring on endwall assemblies 100. The number and arrangements of cooling fluid channels 120, cooling fluid inlets 200, and/or cooling fluid outlets may vary circumferentially from endwall 100 to endwall 100 around the ring in order to optimize cooling at hot spots around the ring of airfoils.

The logic illustrated in the flow diagrams may include additional, different, or fewer operations than illustrated. The operations illustrated may be performed in an order different than illustrated.

To clarify the use of and to hereby provide notice to the public, the phrases "at least one of <A>, <B>, . . . and <N>" or "at least one of <A>, <B>, . . . <N>, or combinations thereof" or "<A>, <B>, . . . and/or <N>" are defined by the Applicant in the broadest sense, superseding any other implied definitions hereinbefore or hereinafter unless expressly asserted by the Applicant to the contrary, to mean one or more elements selected from the group comprising A, B, . . . and N. In other words, the phrases mean any combination of one or more of the elements A, B, . . . or N including any one element alone or the one element in combination with one or more of the other elements which may also include, in combination, additional elements not listed. Unless otherwise indicated or the context suggests otherwise, as used herein, "a" or "an" means "at least one" or "one or more."

While various embodiments have been described, it will be apparent to those of ordinary skill in the art that many more embodiments and implementations are possible. Accordingly, the embodiments described herein are examples, not the only possible embodiments and implementations.

The subject-matter of the disclosure may also relate, among others, to the following aspects:

A first aspect relates to an endwall, the endwall disposed at one end of a vane assembly, the endwall comprising: an endwall spar, the endwall spar including a cold surface, a hot surface opposite the cold surface, a leading edge, a trailing edge, and an axis extending from the leading edge to the trailing edge, the axis perpendicular to the trailing edge, and a coversheet on the hot surface of the endwall spar, the coversheet including a cold surface of the coversheet, the cold surface of the coversheet facing the hot surface of the endwall spar, and a hot surface of the coversheet opposite the cold surface of the coversheet; and a cooling fluid channel between the hot surface of the endwall spar and the cold surface of the coversheet, the cooling fluid channel including a cooling fluid inlet disposed in the endwall spar, and a cooling fluid outlet, wherein the cooling fluid outlet is at an angle to the axis of the endwall spar to direct a cooling fluid.

A second aspect may relate to the endwall of the first aspect wherein the endwall spar further comprises an airfoil opening disposed at an angle to the axis of the endwall spar.

A third aspect may relate to the endwall of any preceding aspect wherein the angle of the airfoil opening near the airfoil outlet is substantially the same as the angle of the cooling fluid outlet.

A fourth aspect may relate to the endwall of any preceding aspect wherein the cooling fluid outlet is at a different angle than the airfoil opening.

A fifth aspect may relate to the endwall of any preceding aspect wherein the cooling fluid outlet is a film hole disposed in the coversheet.

A sixth aspect may relate to the endwall of any preceding aspect further comprising a plurality of pedestals disposed on the hot surface of the endwall spar, wherein the cooling fluid outlet is disposed at the trailing edge of the endwall spar and formed between two of the plurality of pedestals that extend to the trailing edge of the endwall spar.

A seventh aspect may relate to the endwall of any preceding aspect wherein the cooling fluid outlet is disposed near the leading edge of the endwall spar.

An eighth aspect may relate to the endwall of any preceding aspect wherein the angle of the cooling fluid outlet with the axis is between 30 and 80 degrees.

A ninth aspect may relate to the endwall of any preceding aspect further comprising a plurality of pedestals disposed on the hot surface of the endwall spar, wherein the pedestals are shaped to direct a cooling fluid to match an angle of flow at the hot surface of the coversheet.

A tenth aspect may relate to the endwall of any preceding aspect further comprising a plurality of pedestals, wherein a first portion of the pedestals are diamond shaped and a second portion of the pedestals are shaped to direct a cooling fluid to match an angle of flow the hot surface of the coversheet.

An eleventh aspect may relate to the endwall of any preceding aspect wherein the cooling fluid outlet comprises an upstream cooling fluid outlet and a downstream cooling fluid outlet, wherein the angle of the upstream cooling fluid outlet is different from the angle of the downstream cooling fluid outlet.

A twelfth aspect may relate to an endwall, the endwall disposed at one end of a vane assembly, the endwall comprising: an endwall spar, the endwall spar including a leading edge, a trailing edge, an axis extending from the leading edge to the trailing edge, the axis perpendicular to the trailing edge, and a plurality of pedestals disposed on a hot surface of the endwall spar; a coversheet on the hot surface of the endwall spar; and a cooling fluid channel between the hot surface of the endwall spar and a cold surface of the coversheet, the cooling fluid channel including a cooling fluid inlet disposed in the endwall spar, and a cooling fluid outlet, the pedestals disposed within the cooling fluid channel between the cooling fluid inlet and the cooling fluid outlet, wherein the plurality of pedestals are formed at an angle with the axis of the endwall spar to direct a cooling fluid.

A thirteenth aspect may relate to the endwall of any preceding aspect wherein the endwall spar further comprises an airfoil opening disposed at an angle to the axis of the endwall spar.

A fourteenth aspect may relate to the endwall of any preceding aspect wherein a degree of the angle of the airfoil opening is the same as a degree of the angle of the pedestals.

A fifteenth aspect may relate to the endwall of any preceding aspect wherein the pedestals are at a different angle than the airfoil opening.

A sixteenth aspect may relate to the endwall of any preceding aspect wherein the angle of the pedestals is between 30 and 80 degrees.

A seventeenth aspect may relate to the endwall of any preceding aspect wherein the endwall further comprises a cooling fluid outlet, the cooling fluid outlet disposed at an angle to the axis, wherein a degree of the cooling fluid outlet angle is the same as a degree of the angle of the pedestals.

An eighteenth aspect may relate to a method of cooling an endwall disposed at one end of a vane assembly, the method comprising: directing cooling fluid through a cooling fluid inlet, the cooling fluid inlet disposed in an endwall spar of the endwall, the endwall spar including a leading edge, a trailing edge, and an axis extending from the leading edge to the trailing edge, the axis perpendicular to the trailing edge; directing the cooling fluid through a cooling fluid channel, the cooling fluid channel formed between a hot surface of the endwall spar and a cold surface of a coversheet disposed on top of the endwall spar; directing the cooling fluid in a direction to match a direction of flow of a primary flow flowing over a hot surface of the coversheet; and ejecting the cooling fluid from a cooling fluid outlet at an angle that matches the direction of flow of a primary flow flowing over the hot surface of the coversheet.

A nineteenth aspect may relate to the method of any preceding aspect wherein the cooling fluid is directed by a plurality of pedestals disposed in the cooling fluid channel, the pedestals formed at an angle with the axis of the endwall spar to redirect the cooling fluid.

A twentieth aspect may relate to the method of any preceding aspect wherein the cooling fluid is directed by the cooling fluid outlet, an opening of the cooling fluid outlet formed at an angle with the axis of the endwall spar to redirect the cooling fluid.

In addition to the features mentioned in each of the independent aspects enumerated above, some examples may show, alone or in combination, the optional features mentioned in the dependent aspects and/or as disclosed in the description above and shown in the figures.

What is claimed is:

1. An endwall, the endwall disposed at one end of a vane assembly, the endwall comprising:

an endwall spar, the endwall spar including
- a cold surface,
- a hot surface opposite the cold surface,
- a leading edge,
- a trailing edge, and
- an axis extending from the leading edge to the trailing edge, the axis perpendicular to the trailing edge, and a coversheet on the hot surface of the endwall spar, the coversheet including a cold surface of the coversheet, the cold surface of the coversheet facing the hot surface of the endwall spar, and a hot surface of the coversheet opposite the cold surface of the coversheet; and a cooling fluid channel between the hot surface of the endwall spar and the cold surface of the coversheet, the cooling fluid channel including a cooling fluid inlet disposed in the endwall spar, and a cooling fluid outlet, wherein the cooling fluid outlet is at an angle to the axis of the endwall spar to direct a cooling fluid.

2. The endwall of claim 1 wherein the endwall spar further comprises an airfoil opening disposed at an angle to the axis of the endwall spar.

3. The endwall of claim 2 wherein the angle of the airfoil opening near the airfoil outlet is substantially the same as the angle of the cooling fluid outlet.

4. The endwall of claim 2 wherein the cooling fluid outlet is at a different angle than the airfoil opening.

5. The endwall of claim 1 wherein the cooling fluid outlet is a film hole disposed in the coversheet.

6. The endwall of claim 1 further comprising a plurality of pedestals disposed on the hot surface of the endwall spar, wherein the cooling fluid outlet is disposed at the trailing edge of the endwall spar and formed between two of the plurality of pedestals that extend to the trailing edge of the endwall spar.

7. The endwall of claim 1 wherein the cooling fluid outlet is disposed near the leading edge of the endwall spar.

8. The endwall of claim 1 wherein the angle of the cooling fluid outlet with the axis is between 30 and 80 degrees.

9. The endwall of claim 1 further comprising a plurality of pedestals disposed on the hot surface of the endwall spar, wherein the pedestals are shaped to direct a cooling fluid to match an angle of flow at the hot surface of the coversheet.

10. The endwall of claim 1 further comprising a plurality of pedestals, wherein a first portion of the pedestals are diamond shaped and a second portion of the pedestals are shaped to direct a cooling fluid to match an angle of flow the hot surface of the coversheet.

11. The endwall of claim 1 wherein the cooling fluid outlet comprises an upstream cooling fluid outlet and a downstream cooling fluid outlet, wherein the angle of the upstream cooling fluid outlet is different from the angle of the downstream cooling fluid outlet.

12. An endwall, the endwall disposed at one end of a vane assembly, the endwall comprising:

an endwall spar, the endwall spar including a leading edge, a trailing edge, an axis extending from the leading edge to the trailing edge, the axis perpendicular to the trailing edge, and a plurality of pedestals disposed on a hot surface of the endwall spar;

a coversheet on the hot surface of the endwall spar; and a cooling fluid channel between the hot surface of the endwall spar and a cold surface of the coversheet, the cooling fluid channel including a cooling fluid inlet disposed in the endwall spar, and a cooling fluid outlet, the pedestals disposed within the cooling fluid channel between the cooling fluid inlet and the cooling fluid outlet, wherein the plurality of pedestals are formed at an angle with the axis of the endwall spar to direct a cooling fluid.

13. The endwall of claim 12 wherein the endwall spar further comprises an airfoil opening disposed at an angle to the axis of the endwall spar.

14. The endwall of claim 13 wherein a degree of the angle of the airfoil opening is the same as a degree of the angle of the pedestals.

15. The endwall of claim 13 wherein the pedestals are at a different angle than the airfoil opening.

16. The endwall of claim 12 wherein the angle of the pedestals is between 30 and 80 degrees.

17. The endwall of claim 13 wherein the endwall further comprises a cooling fluid outlet, the cooling fluid outlet disposed at an angle to the axis, wherein a degree of the cooling fluid outlet angle is the same as a degree of the angle of the pedestals.

18. A method of cooling an endwall disposed at one end of a vane assembly, the method comprising:

directing cooling fluid through a cooling fluid inlet, the cooling fluid inlet disposed in an endwall spar of the endwall, the endwall spar including a leading edge, a trailing edge, and an axis extending from the leading edge to the trailing edge, the axis perpendicular to the trailing edge;

directing the cooling fluid through a cooling fluid channel, the cooling fluid channel formed between a hot surface of the endwall spar and a cold surface of a coversheet disposed on top of the endwall spar;

directing the cooling fluid in a direction to match a direction of flow of a primary flow flowing over a hot surface of the coversheet; and ejecting the cooling fluid from a cooling fluid outlet at an angle that matches the direction of flow of a primary flow flowing over the hot surface of the coversheet.

19. The method of claim 18 wherein the cooling fluid is directed by a plurality of pedestals disposed in the cooling fluid channel, the pedestals formed at an angle with the axis of the endwall spar to redirect the cooling fluid.

20. The method of claim 18 wherein the cooling fluid is directed by the cooling fluid outlet, an opening of the cooling fluid outlet formed at an angle with the axis of the endwall spar to redirect the cooling fluid.

* * * * *